US006169273B1

(12) United States Patent
Liou

(10) Patent No.: US 6,169,273 B1
(45) Date of Patent: Jan. 2, 2001

(54) DYNAMIC RECIRCULATION SYSTEM FOR HEATING AND STORING EMULSIFIED FUEL OIL

(75) Inventor: Jen-Lian Liou, Taoyuan (TW)

(73) Assignee: Fueltec Energy Technology Corporation, Taoyuan (TW)

( * ) Notice: Under 35 U.S.C. 154(b), the term of this patent shall be extended for 0 days.

(21) Appl. No.: 09/184,138

(22) Filed: Oct. 31, 1998

(51) Int. Cl.[7] ..... F27D 11/00; F24H 1/18

(52) U.S. Cl. ..... 219/441; 392/449; 392/465; 165/163

(58) Field of Search ..... 219/421; 392/449, 392/465; 165/163; 137/13, 15, 334, 339, 341

(56) References Cited

U.S. PATENT DOCUMENTS 3,561,645 * 2/1971 Hopkins ..... 222/146
3,874,399 * 4/1975 Ishihara ..... 137/13
4,844,927 * 7/1989 Morris, II et al. ..... 426/307
6,002,838 * 12/1999 Nir ..... 392/449

* cited by examiner

*Primary Examiner*—Teresa Walberg
*Assistant Examiner*—Thor Campbell

(57) ABSTRACT

A dynamic recirculation system for heating and storing emulsified fuel oil includes: a recirculative heater provided on a feed pipe for feeding emulsified fuel oil into a daily storage tank, and a feedback pipe connected to an outlet pipe of the tank for directing a returning oil streamflow to be heated and warmed by the recirculatvie heater at a predetermined optimum temperature for recirculating and storing the warm emulsified fuel oil for preventing overheating of the emulsified fuel oil and preventing separation of water from emulsified fuel oil, thereby maintaining a stable homogeneous emulsified fuel oil for a better combustion in a furnace or boiler.

5 Claims, 2 Drawing Sheets

DYNAMIC RECIRCULATION SYSTEM FOR HEATING AND STORING EMULSIFIED FUEL OIL

BACKGROUND OF THE INVENTION

A conventional fuel oil such as heavy oil may be processed to become an emulsified fuel oil by adding water and emulsifying agent therein for saving fuel and reducing hazardous combustion exhaust gases.

As shown in FIG. 3, the emulsified fuel oil as stored in the storage tank T should be warmed by a heater such as a heating coil or a suction heater H provided in the tank T in order to maintain a proper viscosity and fluidity for the fuel oil which can thus be pumped to a burner Br of a furnace or boiler for combustion use. However, the emulsified fuel oil, contacting the heating coil or pipe of the heater H with high skin temperature on the pipe surface, may be overheated to cause separation S of water from the emulsified oil which was previously emulsified and well mixed, thereby deteriorating the emulsified fuel oil or even causing burning difficulty.

The present inventor has found the drawbacks of the conventional emulsified fuel oil storage system, and invented the present dynamic recirculation system for heating and storing emulsified fuel oil.

SUMMARY OF THE INVENTION

The object of the present invention is to provide a dynamic recirculation system for heating and storing emulsified fuel oil including: a recirculative heater provided on a feed pipe for feeding emulsified fuel oil into a daily storage tank, and a feedback pipe connected to an outlet pipe of the tank for directing a returning oil streamflow to be heated and warmed by the recirculatvie heater at a predetermined optimum temperature for recirculating and storing the warm emulsified fuel oil for preventing overheating of the emulsified fuel oil and preventing separation of water from emulsified fuel oil, thereby maintaining a stable homogeneous emulsified fuel oil for a better combustion in a furnace or boiler.

DETAILED DESCRIPTION

Figure 1:
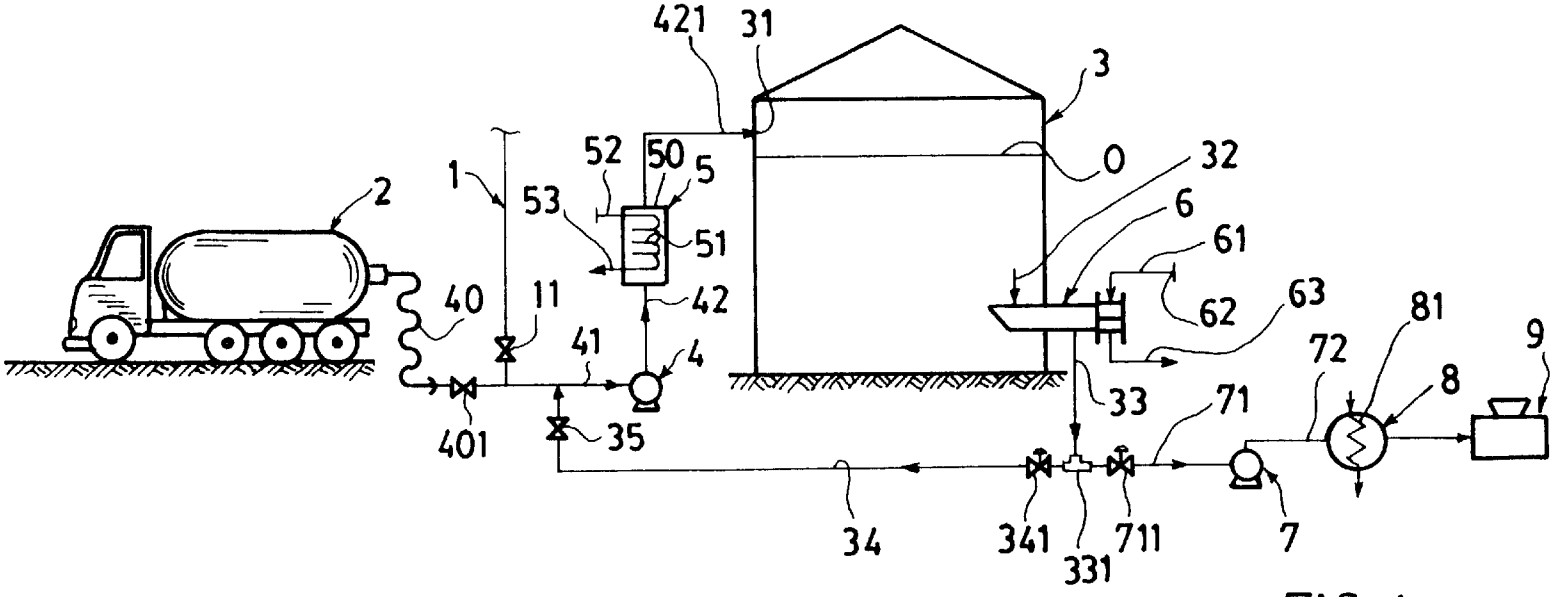
FIG. 1 is a flow sheet showing the system of the present invention.

As shown in FIG. 1, a heating and storage system for emulsified fuel oil of the present invention comprises: a delivery pipe 1 for delivering emulsified fuel oil (including water-in-oil type, oil-in-water type or multiple-phase micro-emulsified type) from a plant where the emulsified fuel oil (not shown) is made, an oil tank truck 2 having emulsified fuel oil loaded therein (having, for instance, transported from the plant of fuel oil), a daily storage tank 3 for storing the emulsified fuel oil O as fed by a charging pump 4 connectable with the delivery pipe 1 and the tank truck 2, a recirculative heater 5 provided between the charging pump 4 and the storage tank 3 for dynamically recirculatively heating or warming emulsified fuel oil O as fed or returned into the tank 3 as illustrated, an outlet heater 6 provided at or in a lower portion of the storage tank 3 for heating outlet oil as input into the heater 6 through an outlet port 32 and having an outlet pipe 33 as output from the heater 6, a burner-side pump 7 and a burner-side heater 8 are connected in between the outlet pipe 33 and a burner 9 of a combustion equipment (not shown) such as a furnace, a boiler, a combustion engine, etc.

The daily storage tank 3 is so designated because the storage tank should have a capacity for storing the emulsified fuel oil of 24-hour consumption as required by the combustion equipment or device (not shown). The delivery pipe is provided with a valve 11 thereon; while the tank truck 2 having an unloading hose 40, formed with a valve 401 thereon, both pipe 11 and hose 40 being connected to a suction pipe 41 formed on a suction side of the charging pump 4 for feeding emulsified fuel oil O into the storage tank 3 as pumped by the charging pump 4.

The charging pump 4 has a feed pipe 42 formed at a discharge side (end) of the pump 4 for pumping the emulsified fuel oil into the storage tank 3 through an inlet port 31 formed on an upper portion of the tank 3.

The outlet pipe 33 includes a three-way (or tee) valve or joint 331 for connecting a feedback pipe 34 recirculatively connected to the suction pipe 41 of the charging pump 4 and for connecting an output pipe 71 connected to a suction side (end) of a burner-side pump 7 having a valve 711 formed on the output pipe 71.

The feedback pipe 34 as branched from the outlet pipe 33 includes a first valve 341 adjacent to the valve or joint 331 and a second valve 35 near the suction pipe 41 for on-off control of a recirculative streamflow of oil which is returned to be dynamically recirculatively heated or warmed by the recirculative heater 5 and then be re-fed into the tank 3.

The burner-side pump 7 will pump the warm emulsified fuel oil through a pipe 72 to be further heated by a burner-side heater 8 up to 120° C. (for example) by a heating medium 81 which may be a steam or electric coil, with the oil fed into the burner 9 to be atomized for combustion in the combustion equipment or device.

The outlet heater 6 may be a suction heater or other types of heaters, including a heating device 61 having an inlet 62 for entering a heating medium (such as steam) and an outlet 63 for discharging the heating medium (such as condensate). The heating device 61 may also be an electric heating device, not limited in the present invention.

The recirculative heater 5 includes a heating coil 51 submerged in a heating drum 50 for directing steam or other heating medium into the coil 51 through an inlet 52 for heating the emulsified fuel oil flowing through the heating drum 50 as pumped by the pump 4 and the pipe 42. For instance, an emulsified fuel oil containing heavy oil with water may be heated to 40~50° C. for maintaining a proper fluidity of the oil for a smooth delivery of the warm fuel oil for its final combustion use. The condensate of the heating medium may be discharged from an outlet 53 of the heater 5. The heated oil from the heating drum 50 is then fed into the tank 3 through the feed pipe end 421 and inlet port 31 of the tank 3.

Figures 2, 3:
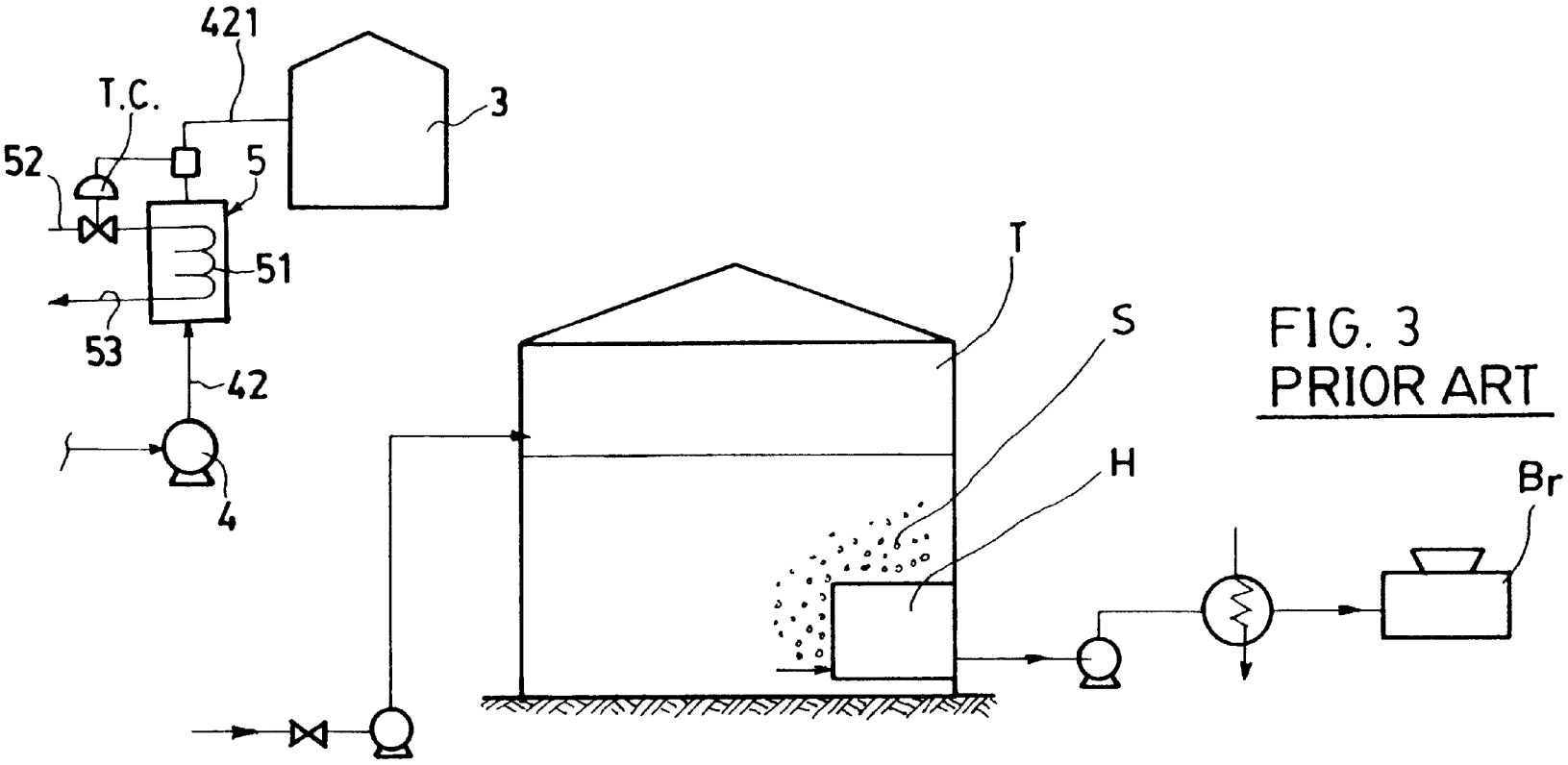
FIG. 3 PRIOR ART
FIG. 2 shows the recirculative heater provided with a temperature controller in accordance with the present invention.
FIG. 3 shows a conventional fuel oil storage system.

The recirculative heater 5 is provided with a temperature controller T.C. especially as shown in FIG. 3 for maintaining a constant optimum temperature for warming the emulsified fuel oil, without overheating the oil and without dissociating the emulsified oil into oil and water.

For auxiliarily heating the fuel oil O as output from the tank 3, the outlet heater 6 is thus provided for continuously heating the fuel oil which is finally fed into the burner 9 for combustion in a furnace, a boiler, a combustion engine, etc, The heating coil 51 of the recirculative heater 5 may also be an electric heating coil 51 for heating the emulsified fuel oil.

Since the fuel oil is dynamically recirculatively heated by the heater 5 to shorten the contacting time between the oil and the heating device, and an optimum heating temperature has been properly controlled, the emulsified oil will not be dissociated or "broken" into oil and water due to local overheating. Meanwhile, the warm oil will maintain a proper viscosity and fluidity for a smooth delivery into the burner.

A preferred example of the present invention is described hereinafter.

EXAMPLE

In the recirculative heater 5, the steam pressure of the heating coil 51 is set at 3.5 kilogram per square centimeter (gauge), and the steam temperature set at 147° C. The flow velocity of the emulsified oil through the heater 5 is gradually increased and the skin temperature on the metal surface of the heating coil 51 is gradually decreased.

When the temperature of the inlet oil (entering the heater 5) is controlled at 45° C. and while the temperature of the outlet oil is controlled at 55° C., the relationship between the oil flow velocity and the skin temperature on the metal surface of the heating coil is obtained as follows:

| Velocity of fuel oil | Skin temperature of heating coil |
|---|---|
| 0.1 m/sec | 137.3° C. |
| 0.5 m/sec | 133.7° C. |
| 1.0 m/sec | 131.2° C. |
| 2.0 m/sec | 128.3° C. |
| 5.0 m/sec | 119.2° C. |

From the data as above-mentioned, the skin temperature will be gradually decreased with respect to an increase of the oil velocity. Even though the skin temperature is reached at 100~120° C., the emulsified fuel oil will not be "broken" (dissociated into oil and water) if the oil flow velocity through the heater 5 is properly controlled within 5~10 meters/second, and the contacting time between the oil and the metallic heating coil is less than 40 seconds in accordance with the present invention.

The present invention discloses a "dynamic" recirculative heating method for dynamically warming the emulsified fuel oil at a shortened contacting time to prevent overheating and dissociation of the oil and to obtain a better viscosity and fluidity of the oil beneficial for the pumping delivery from the tank to a burner of a furnace or the like. The "dynamic" process of the present invention is superior to a "static" heating system as found in a conventional storage system for emulsified fuel oil.

The recirculative heater 5 of the present invention may be a heat-exchanger to allow a heating medium (steam) through the heating coil 51 to heat the recirculated oil through the heating drum 50, through which the coil 51 is passed. Other models of heat exchangers including double-pipe may be provided in this invention for recirculative heating purpose.

The present invention may be modified by those skilled in the art without departing from the spirit and scope as claimed in the present invention.

What is claimed is:

1. A heating and storage system for emulsified fuel oil as made by mixing fuel oil with water comprising:

a storage tank including a charging pump having a suction pipe disposed at a suction side of said charging pump and connectable with a delivery pipe of a plant or with an unloading hose of an oil tank truck, and having a feed pipe disposed at a discharge side of said charging pump and connected to said storage tank for pumping an emulsified fuel oil, as made by mixing fuel oil with water, into said storage tank; and an outlet pipe connected between said storage tank and a burner of a combustion equipment including furnace, boiler and combustion engines;

the improvement which comprises:

said outlet pipe branched with a feedback pipe connected to said suction pipe of said charging pump; and a recirculative heater connected in said feed pipe for dynamically recirculatively heating and warming the emulsified fuel oil as recirculated from said feedback pipe and as sucked from the delivery pipe of the plant or from the unloading hose of the oil tank truck at an optimum warming temperature for warming said emulsified fuel oil at a shortened contacting time between the fuel oil and said recirculative heater to prevent overheating and dissociation of said emulsified fuel oil (separation of water from the emulsified fuel oil) and to obtain a proper viscosity and fluidity of said emulsified fuel oil for a smooth delivery from said storage tank to said burner; said recirculative heater including a heating coil submerged in a heating drum connected in said feed pipe for directing a heating medium into said heating coil for heating the emulsified fuel oil as flowing in the heating drum through said feed pipe, said emulsified fuel oil recirculatively returning into said storage tank as pumped by said charging pump.

2. A heating and storage system according to claim 1, wherein said heating medium is steam.

3. A heating and storage system according to claim 1, wherein said recirculative heater includes a temperature controller for controlling an optimum temperature for warming said emulsified fuel oil without overheating and dissociating said emulsified fuel oil.

4. A heating and storage system according to claim 1, wherein said outlet pipe is connected to an outlet heater provided in or at a lower portion of said storage tank for further heating the emulsified fuel oil as discharged from said storage tank to said burner for maintaining a good viscosity and fluidity of said emulsified fuel oil to be delivered from said storage tank to said burner.

5. A heating and storage system according to claim 1, wherein said feedback pipe includes a first valve formed on said feedback pipe adjacent to a three-way tee valve which is connected with said feedback pipe, said outlet pipe and an output pipe branched from said outlet pipe to be connectable to said burner; and a second valve formed on said feedback pipe adjacent to said suction pipe of said charging pump of said storage tank.

* * * * *